US005444879A

United States Patent [19]

Holtsnider

[11] Patent Number: 5,444,879

[45] Date of Patent: Aug. 29, 1995

[54] PULSATING WATER INJECTION SYSTEM AND VALVE FOR HYDROTHERAPY SPA WITH HELICAL WATER DISTRIBUTION GROOVE

[75] Inventor: Michael D. Holtsnider, Camarillo, Calif.

[73] Assignee: B&S Plastics, Inc., Oxnard, Calif.

[21] Appl. No.: 237,921

[22] Filed: May 3, 1994

Related U.S. Application Data

[63] Continuation-in-part of Ser. No. 54,535, Apr. 27, 1993, abandoned.

[51] Int. Cl.[6] ..... E03C 1/048

[52] U.S. Cl. ..... 4/541.01; 4/541.3; 239/99; 239/98; 137/561 A; 137/262

[58] Field of Search ..... 4/541.1, 541.2, 541.3, 4/541.4, 541.5, 541.6; 239/98, 99; 137/262, 561 A, 561 R, 565.1; 601/149, 150

[56] References Cited

U.S. PATENT DOCUMENTS

| | | | |
|---|---|---|---|
| 2,345,073 | 3/1944 | Rosett | 601/149 |
| 2,478,392 | 8/1949 | Harrison | 299/27 |
| 2,558,376 | 6/1951 | Opp et al. | 47/1.3 |
| 2,568,096 | 9/1951 | Stewart | 51/262 |
| 2,781,041 | 2/1957 | Weinberg | 601/149 |
| 2,878,066 | 3/1959 | Erwin | 299/141 |
| 3,182,867 | 5/1965 | Barosko et al. | 222/486 |
| 3,233,997 | 2/1966 | Moreau | 65/184 |
| 3,353,752 | 11/1967 | Ranhagen et al. | 239/538 |
| 3,807,446 | 4/1974 | Driskell et al. | 137/561 |
| 4,150,512 | 4/1979 | Novak | 51/262 |
| 4,220,145 | 9/1980 | Stamp et al. | 128/66 |
| 4,508,665 | 4/1985 | Spinnett | 261/93 |
| 4,549,567 | 10/1985 | Horton | 137/262 |
| 4,954,179 | 9/1990 | Franninge | 4/541.1 |

FOREIGN PATENT DOCUMENTS

| | | | |
|---|---|---|---|
| 1566497 | 10/1970 | Germany . | |
| 3638509 | 5/1988 | Germany | A61H 33/02 |
| 2181643 | 4/1987 | United Kingdom | A61H 33/00 |
| 1389863 | 4/1988 | U.S.S.R. . | |

*Primary Examiner*—Henry J. Recla
*Assistant Examiner*—Charles R. Eloshway
*Attorney, Agent, or Firm*—Koppel & Jacobs

[57] ABSTRACT

A plurality of water injection nozzles (16) are spaced around the tub (12) of a hydrotherapy spa (10) for injecting a pulsating flow of water and air into the main body of water (14) in the tub (12). The pulsation is produced by a distribution valve (30), (80) including a rotor (46), (92) which is rotated by the inlet water flow and distributes the inlet water to outlets (40,42,44), (90) which are connected to the nozzles (16) respectively. The rotor (46), (92) is formed with a groove (48), (96) which sequentially aligns with and connects the outlets (40,42,44), (90) to the inlet (34), (86). Since each outlet (40,42,44), (90) is periodically connected to and disconnected from the inlet (34), (86), the water is supplied to each nozzle (16) in a pulsating or chopped manner. The sequence in which the water is distributed to the nozzles (16) is fixed, enabling a rippling effect to be produced in which the pulsation appears to rotate around the spa (10).

15 Claims, 7 Drawing Sheets

PULSATING WATER INJECTION SYSTEM AND VALVE FOR HYDROTHERAPY SPA WITH HELICAL WATER DISTRIBUTION GROOVE

RELATED APPLICATION

This application is a continuation-in-part of application Ser. No. 08/054,535, filed Apr. 27, 1993, now abandoned.

BACKGROUND OF THE INVENTION

1. Field of the Invention

The present invention generally relates to hydrotherapy spas, and more specifically to a water injection system including a valve which is driven by inlet water flow and distributes the water to injection nozzles which are spaced around the spa in a pulsating manner.

2. Description of the Related Art

A hydrotherapy spa, also known as a hot tub or a Jacuzzi, is provided with a number of nozzles or jets around its periphery for injection of a massaging mixture of water and air into the main body of water in the spa. The injected bubbling water has a pleasant, soothing and therapeutic effect.

Water from a suitable source is conventionally supplied via a manifold valve to all of the nozzles in a continuous manner. However, the beneficial effects of the injected water are enhanced if the water is supplied in a pulsating, rather than a continuous manner.

Various expedients have been conceived for introducing pulsation into the injected water, including intermittently blocking and unblocking the inlet water or air flow to the nozzles, and intermittently disabling venturis which cause aspiration of air into the water flow through the nozzles.

A typical prior art pulsating water injection system is describe in U.S. Pat. No. 4,508,665, entitled "RETROFIT PULSATOR APPARATUS AND METHOD FOR AN AIR/WATER MIXER OF A SWIMMING POOL, THERAPY TUB, SPA OR THE LIKE", issued Apr. 2, 1985 to R. Spinnett, which discloses a retrofit assembly for a spa nozzle including a rotor which is driven by the inlet water flow and intermittently interrupts the outlet water flow.

Prior art systems such as disclosed by Spinnett require a separate pulsator unit for each nozzle, increasing the complexity, cost and maintenance of the spa. In addition, since the pulsator units operate independently, they cannot be synchronized to provide a rippling effect in which the pulsation appears to rotate around the spa.

SUMMARY OF THE INVENTION

In accordance with the present invention, a plurality of water injection nozzles are spaced around the periphery of a tub of a hydrotherapy spa for injecting a pulsating flow of water and air into the main body of water in the tub.

The pulsation is produced by a distribution valve including a rotor which is rotated by the inlet water flow and distributes the inlet water to outlets which are connected to the nozzles respectively. The outlets can be spaced longitudinally along and/or rotationally about the axis of the valve.

The rotor is formed with a groove which sequentially aligns with and connects the outlets to the inlet. Since each outlet is periodically connected to and disconnected from the inlet, the water is supplied to each nozzle in a pulsating or chopped manner.

The groove can be formed in a helical shape in the circumferential surface of the rotor. Alternatively, the rotor ,can have a longitudinal bore, and the groove formed in a spiral shape which extends through the rotor from the bore to the circumferential surface thereof.

The sequence in which the water is distributed to the nozzles is fixed, enabling a rippling effect to be produced in which the pulsation appears to rotate around the spa.

In addition, more nozzles can be provided without increasing the amount of injected water or, conversely, decreasing the amount of injected water with the same number of nozzles. This is because only one or a few of the nozzles are injecting water at any one time, as opposed to all of the nozzles in the prior art.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
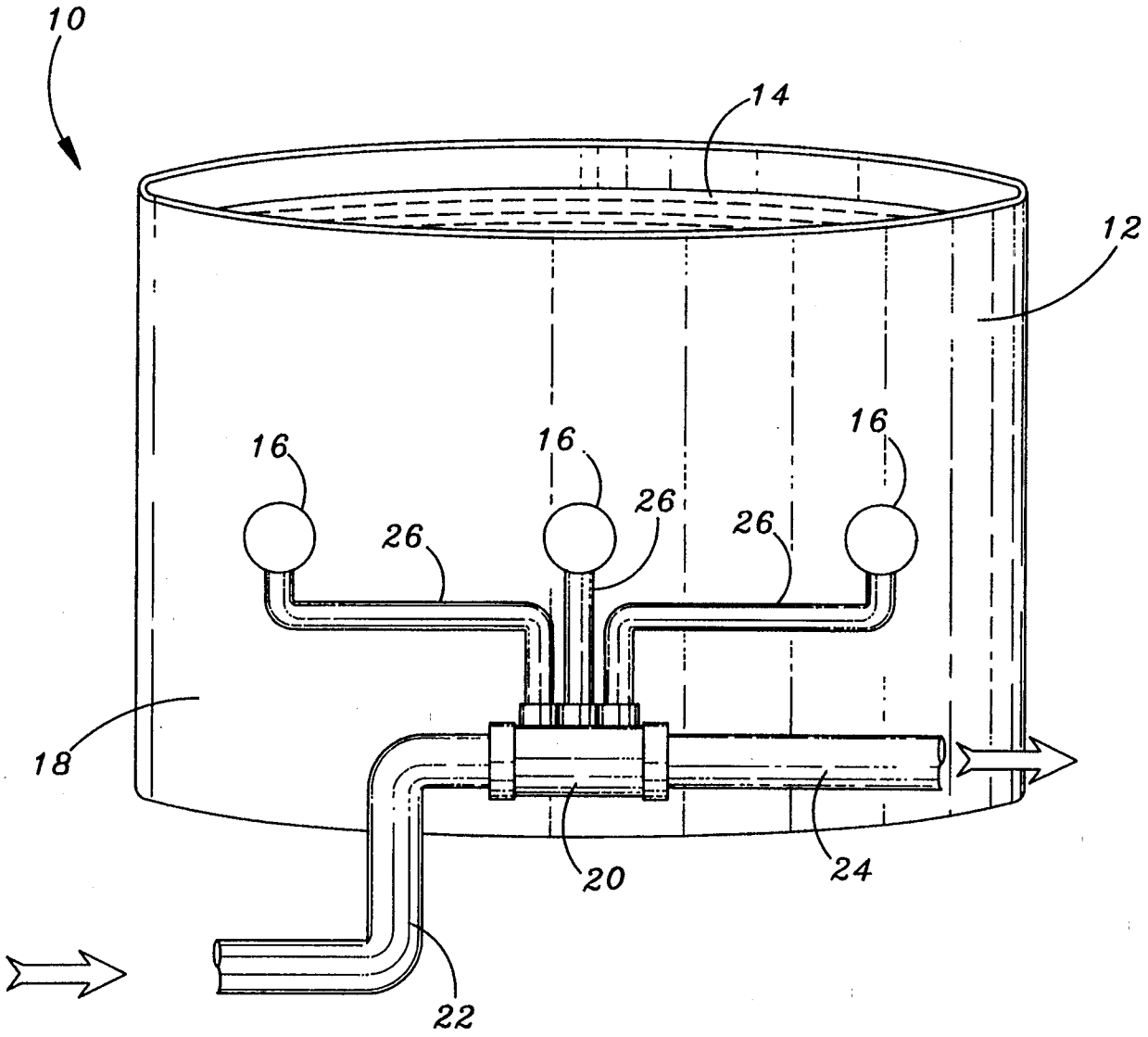
FIG. 1 is a simplified perspective view illustrating a hydrotherapy spa including a water distribution valve system embodying the present invention.

As illustrated in FIG. 1, a hydrotherapy spa 10 includes a tub 12 which is filled with a main body of water 14. A plurality of jets or nozzles 16 are circumferentially spaced around and open into the tub 12 for injecting pulsating jets of water and entrained air into the water 14. The injected bubbling water has a pleasant, soothing and therapeutic effect. Although not illustrated in detail, each nozzle 16 includes a venturi or other device for mixing air with the water flowing therethrough into the tub 12.

A water injection system 18 embodying the present invention includes a water manifold or distribution valve 20. Water from a suitable source is supplied into the valve 20 through an inlet conduit 22. Further illustrated is an outlet conduit 24 which enables water which is not distributed to the nozzles 16 to pass through the valve 20 and be supplied to a similar valve and nozzles (not shown) on the side of the tub 12 which is not visible in the drawing. If only one valve 20 is provided in the system 18, the outlet conduit, 24 can be replaced by a plug.

The system 18 further includes conduits 26 which connect the valve 20 to the nozzles 16 respectively. In accordance with the invention, the valve 20 sequentially supplies water to the nozzles 16 in a pulsating manner. This enhances the beneficial effects of the injected water. Since the valve 20 supplies water to the nozzles 16 one after the other, it creates a ripple effect in which the pulsation appears to rotate around the tub 12.

Although the valve 20 is illustrated in FIG. 1 as distributing water to only three nozzles 16 for simplicity of illustration, a water distribution valve embodying the invention can be configured to distribute water to any number of nozzles.

Figure 2:
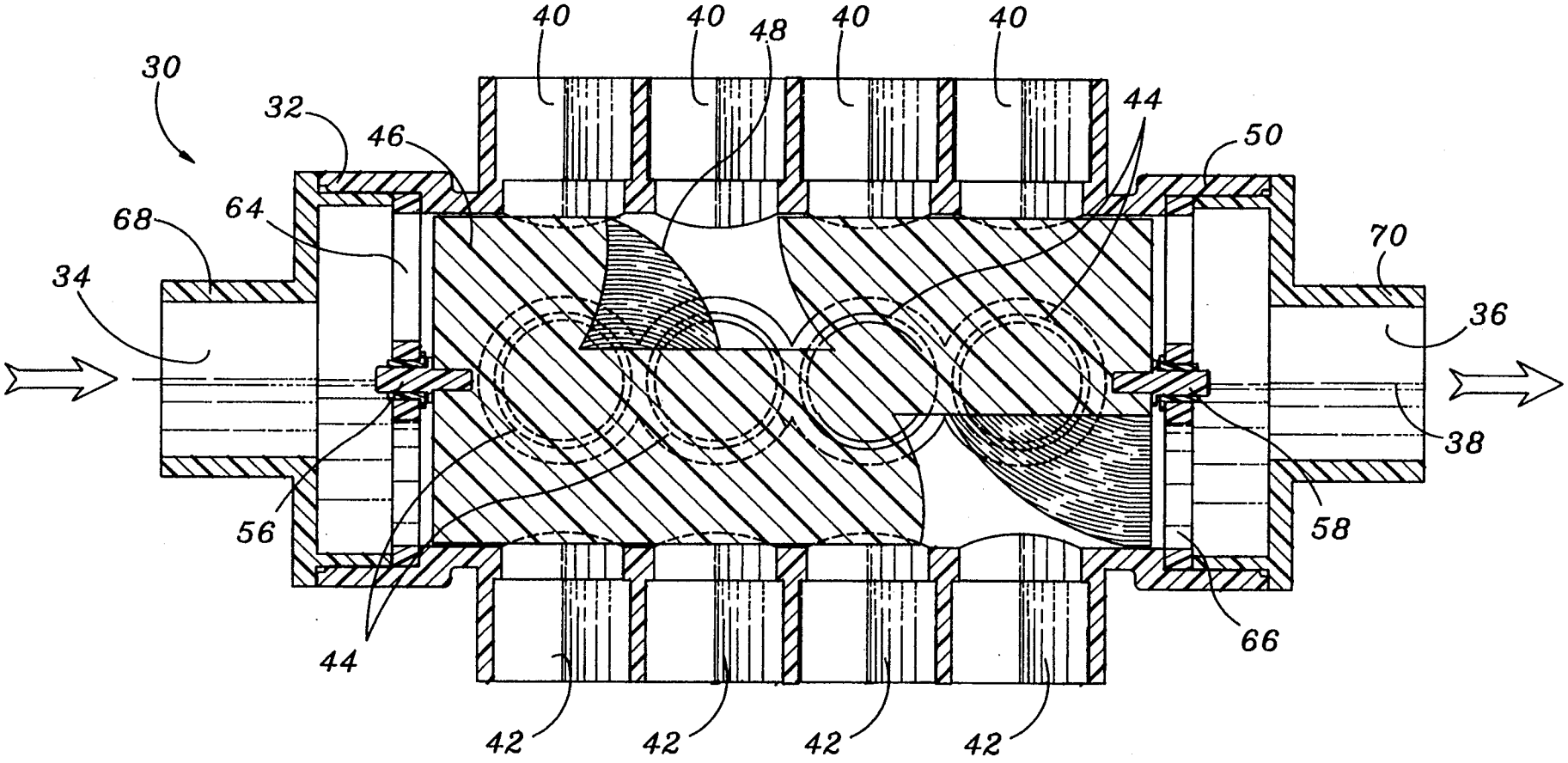
FIG. 2 is a longitudinal sectional view illustrating a first embodiment of a water distribution valve for the system of FIG. 1.
Figure 3:
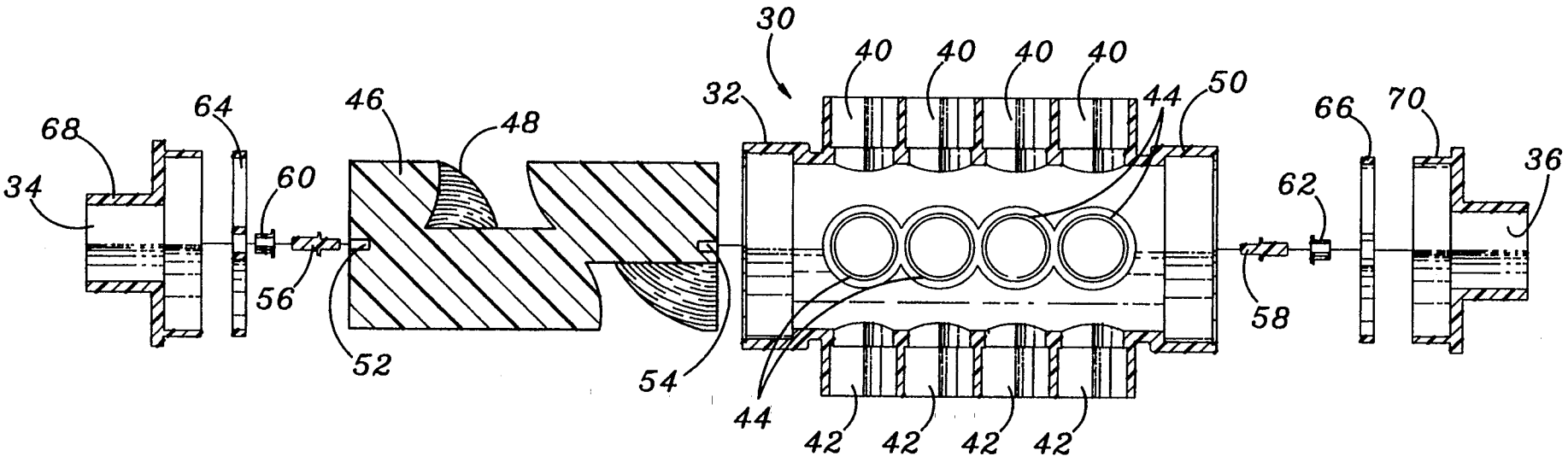
FIG. 3 is an exploded sectional view illustrating the valve of FIG. 2.
Figure 4:
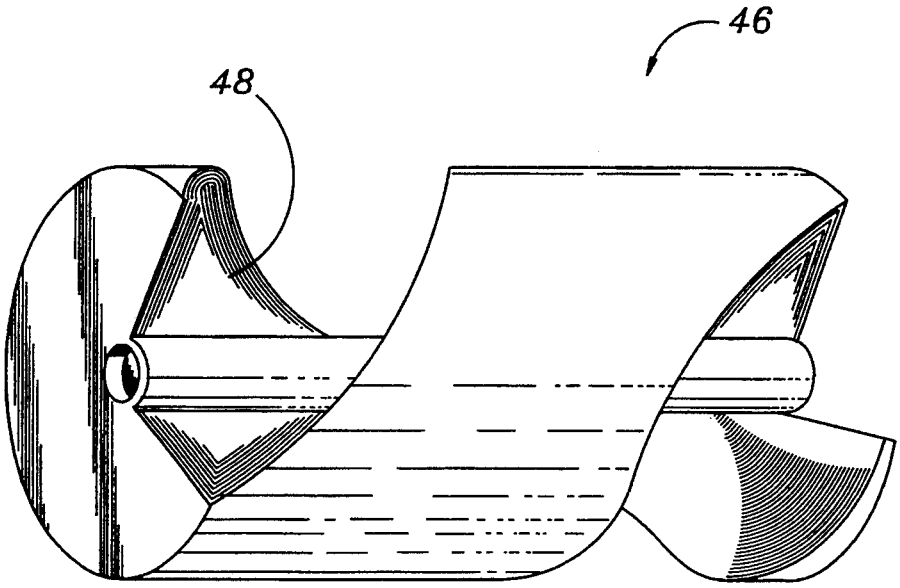
FIG. 4 is a perspective view illustrating a rotor of the valve of FIG. 2.

A water manifold or distribution valve 30 which is illustrated in FIGS. 2 to 4 is essentially similar to the valve 20, except that it distributes water to twelve nozzles rather than to only three nozzles. The valve 30 includes a housing 32 having a longitudinal inlet 34 and a longitudinal outlet 36 which are aligned along a longitudinal axis 38. A first row of radial outlets 40, a second row of radial outlets 42 and third row of radial outlets 44 are formed in the housing 32.

Whereas the individual outlets 40, 42 and 44 in the respective rows are longitudinally spaced from each other along the axis 38, the rows of outlets 40, 44 and 42 are rotationally spaced from each other about the axis 38 by increments of 90° respectively. It is generally within the scope of the invention to provide outlets which are longitudinally and/or rotationally spaced relative to the axis 38 in any number and combination.

The inlet 34 is connected through the conduit 22 as illustrated in FIG. 1 to a source of water. The outlet 36 can be connected through the conduit 24 to another valve 30 (not shown), or can be plugged. The outlets 40, 42 and 44 are connected through the conduits 26 to the nozzles 16.

A rotor in the form of a turbine 46 is supported in the housing 32 for rotation about the axis 38, and is formed with a helical groove 48 in its circumferential surface. In operation, water flowing into the housing 32 through the inlet 34 impinges on the inner surface of the groove 48 and imparts a force to the turbine 46 which causes it to rotate. As the turbine 46 rotates, the groove 48 sequentially aligns with the outlets 40, 42 and 44 and connects them to the inlet 34, thereby enabling water to flow from the inlet 34 through the groove 48 to the aligned outlet 40, 42 or 44.

The groove 48 can have various configurations within the scope of the invention. The groove 48 can be shaped to align with only one outlet 40, 42 or 44 in each rotational position of the turbine 46. Alternatively, the groove 48 can be shaped to at least partially align with more than one, but not all of the outlets 40, 42 and 44 in the particular rotational position of the turbine 46. Although the turbine 46 is illustrated as being formed with only one groove, it is within the scope of the invention to provide a turbine or other rotor configuration with two or more grooves.

Thus, water can be distributed to one nozzle, or more than one but not all of the nozzles, at any one time in accordance with the invention. The alternating alignment and disalignment of the groove 48 with the outlets 40,42 and 44 causes the water to be distributed or supplied to the nozzles in an intermittent manner to create the desired pulsating or chopped effect. Since the water is supplied to the nozzles in a fixed sequence which depends on the locations of the outlets 40, 42 and 44, the pulsation appears to ripple or rotate around the tub 12.

The present invention enables more nozzles to be provided than in a conventional system without increasing the amount of injected water or, conversely, decreasing the amount of injected water with the same number of nozzles. This is because only one or a few of the nozzles are injecting water at any one time, as opposed to all of the nozzles in the prior art.

As best viewed in FIG. 3, the housing 32 includes a body 50. The turbine 46 is formed with longitudinal holes 52 and 54 at its opposite ends which receive stub shafts 56 and 58 respectively. The shafts 56 and 58 are rotatably supported by bearings 60 and 62 which are retained by spiders 64 and 66 which are themselves clamped to the left and right ends of the body 50 by inlet and outlet caps 68 and 70 respectively. The caps 68 and 70 are secured to the body 50 by screw threads, adhesive or the like.

Figure 5:
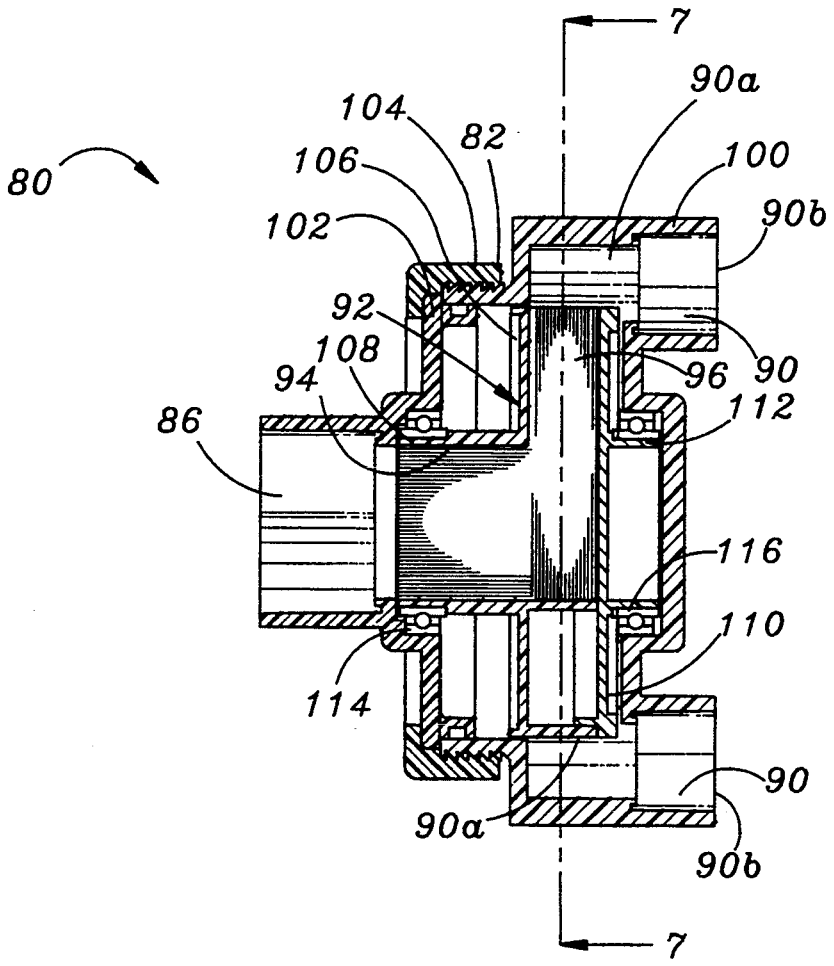
FIG. 5 is a longitudinal sectional view illustrating a second embodiment of a water distribution valve according to the invention.
Figure 6:
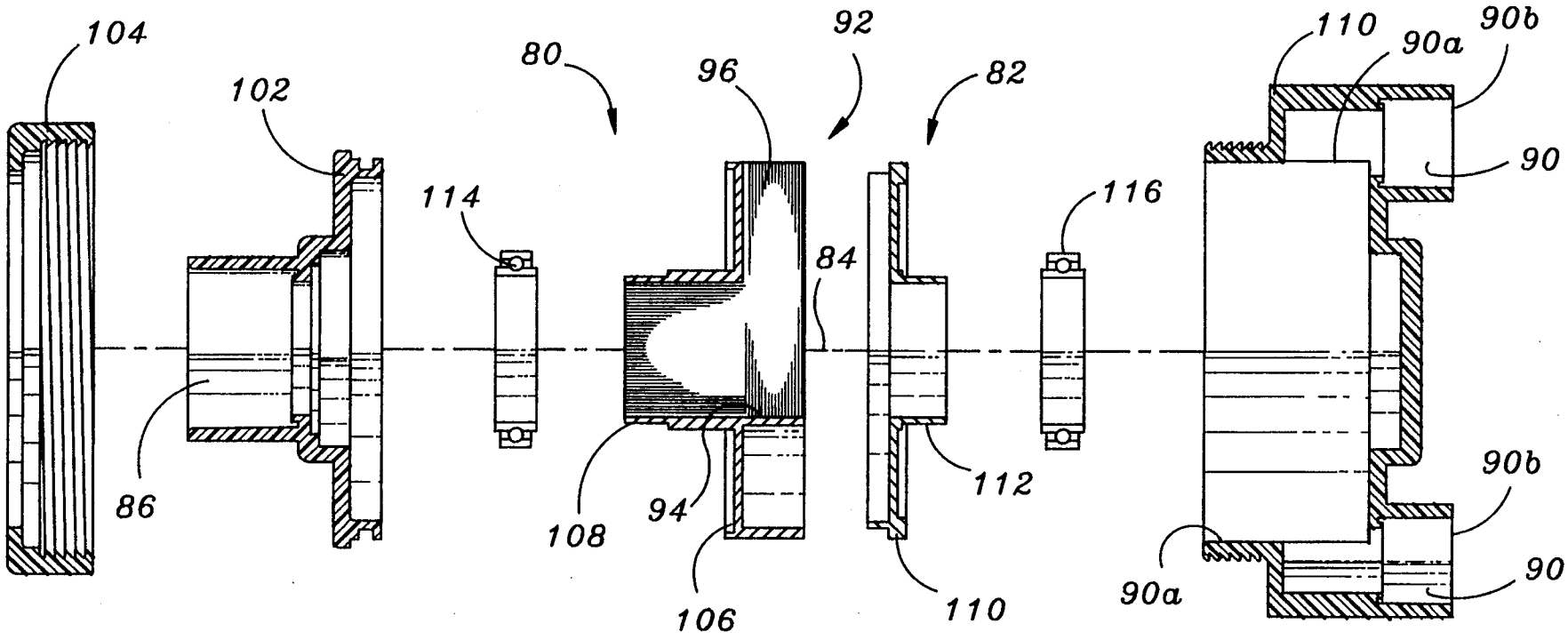
FIG. 6 is an exploded sectional view illustrating the valve of FIG. 5.
Figure 7:
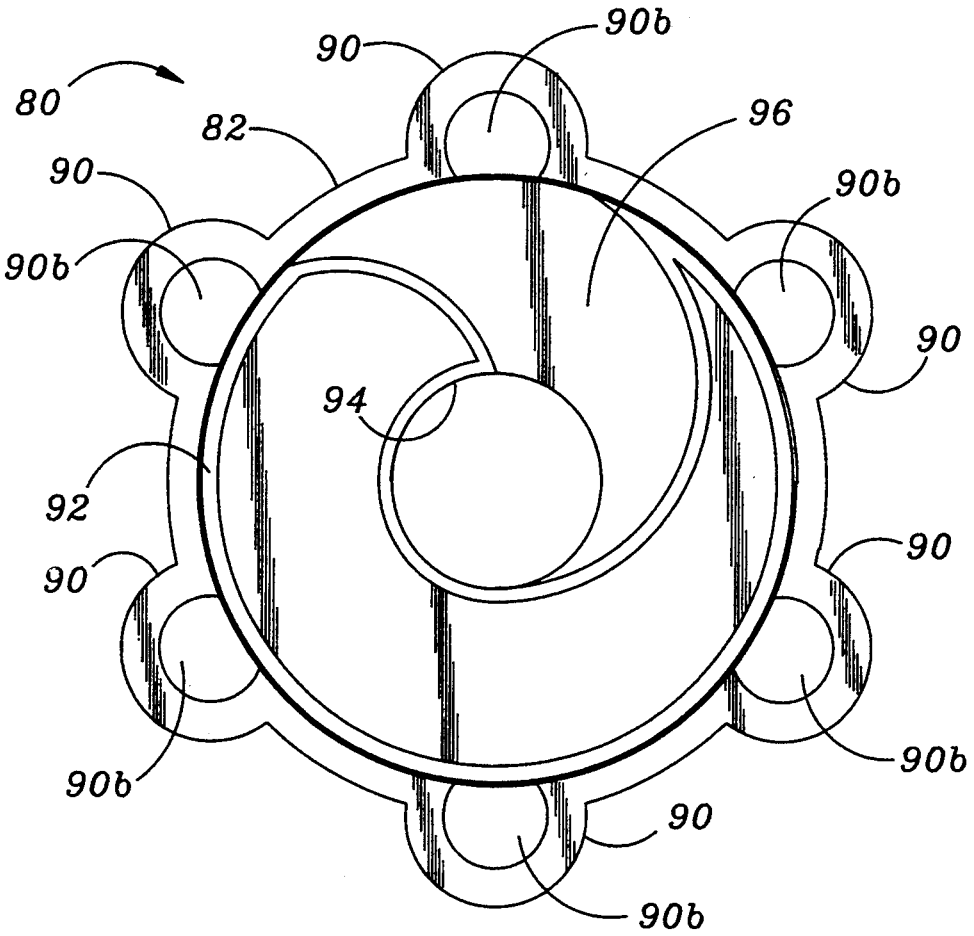
FIG. 7 is a sectional view taken along section line 7—7 of FIG. 5.

The turbine 46 of the valve 30 is driven or caused to rotate by water flowing from the inlet 34 parallel to the rotary axis of the turbine 46. FIGS. 5 to 7 illustrate another water manifold or distribution valve 80 including a rotor is driven by water flowing perpendicular to its rotary axis.

The valve 80 includes a housing 82 having a longitudinal axis 84, and a longitudinal inlet 86 and a longitudinal outlet 88 which are aligned along the axis 84 for connection to the conduits 22 and 24 respectively. The housing 82 further includes six water outlets 90 which are rotationally spaced about the axis 84 for connection through the conduits 26 to the nozzles 16. The outlets 90 each have art inner end **90*a* which opens radially into the housing 82, and an outer end 90*b* which opens longitudinally external of the housing 82**.

A rotor in the form of an impeller 92 is supported inside the housing 82 for rotation about the axis 84. The impeller 92 has a longitudinal bore 94 and, as best viewed in FIG. 7, a spiral groove 96 which extends through the impeller 92 from the bore 94 to the circumferential surface of the impeller 92.

Water flowing into the housing 82 through the inlet 86 parallel to the axis 84 changes direction and flows outwardly through the groove 96 in the impeller 92 perpendicular to the axis 84. The water impinges on the inner surface of the groove 96, causing the impeller 92 to rotate. The radially outer end of the groove 96 which opens through the circumferential surface of the impeller 92 sequentially aligns with the inner ends **90*a* of the outlets 90, causing water to be sequentially distributed from the inlet 86 through the groove 96 to the outlets 90 and thereby to the nozzles 16 in a pulsating or chopped manner as described above with reference to FIGS. 2 to 4**.

As best viewed in FIG. 6, the housing 82 includes a body 100 which is formed with the outlets 90, and an end plate 102 which is formed with the inlet 86. The end plate 102 is secured to the left end of the body 100 by a threaded cap 104.

The rotor 92 is formed in two sections which are fastened together by an adhesive or the like. A main section 106 is formed with the spiral groove 96 and a hub 108. A cover section 110 is formed with a hub 112. The hub 108 is rotatably supported by a bearing 114 which is retained by the end plate 102, whereas the hub 112 is rotatably supported by a bearing 116 which is retained by the body 100.

Although the impeller 92 is illustrated as being formed with only one spiral groove 96, it is within the scope of the invention to provide more than one spiral groove, or to modify the shape of the groove 96 as required for a particular application.

Further, although not specifically illustrated, one or more additional sets of rotationally spaced outlets can be provided which are longitudinally spaced from the outlets 90. The impeller 92 can be elongated longitudinally to distribute water to the additional outlets, or one or more additional impellers can be added.

While several illustrative embodiments of the invention have been shown and described, numerous variations and alternate embodiments will occur to those skilled in the art, without departing from the spirit and scope of the invention.

For example, although the present distribution valve has been described and illustrated as being specifically utilized in a hydrotherapy spa, the valve can alternatively be used for distributing water to ejection nozzles in a swimming pool or other type of tub.

In addition, the valve can be adapted to use in other applications, for example distributing water or liquid fertilizer to ejection nozzles in an agricultural irrigation system.

Accordingly, it is intended that the present invention not be limited solely to the specifically described illustrative embodiments. Various modifications are contemplated and can be made without departing from the spirit and scope of the invention as defined by the appended claims.

I claim:

1. A water injection system for a tub, comprising:

a plurality of nozzles for injecting water into the tub; and a water distribution valve including:

a housing having an inlet for receiving said water and a plurality of outlets connected to the nozzles respectively; and a rotor which is rotatably disposed in the housing and shaped so as to be rotated by said water flowing into the housing from the inlet, said rotor including a water conduit that sequentially aligns with and connects the outlets to the inlet as the rotor rotates, said conduit having an area that substantially encompasses an outlet with which it is aligned;

said housing having a longitudinal axis about which the rotor is rotatably disposed, and said outlets being longitudinally spaced from each other parallel to said longitudinal axis.

2. A system as in claim 1, wherein said outlets have circular cross-sections.

3. A system as in claim 1, further comprising additional outlets that are spaced around said housing and arranged in longitudinal rows parallel to said longitudinal axis, said additional outlets being connected to respective nozzles.

4. A system as in claim 1, wherein said outlets are connected to their respective nozzles by respective conduits that have cross-sectional areas no larger than the cross-sectional areas of the outlets.

5. A water injection system for a tub, comprising:

a plurality of nozzles for injecting water into the tub; and a water distribution valve including:

a housing having an inlet for receiving said water and a plurality of outlets connected to the nozzles respectively; and a rotor which is rotatably disposed in the housing and shaped so as to be rotated by said water flowing into the housing from the inlet and sequentially connect the outlets to the inlet as the rotor rotates;

said housing having a longitudinal axis about which the rotor is rotatably disposed and said outlets being longitudinally spaced from each other parallel to said longitudinal axis; and said rotor being formed with a circumferential surface and a groove in said circumferential surface against which said water impinges from the inlet to cause rotation of the rotor, said groove sequentially aligning with the outlets upon rotation of the rotor, said groove having an area that substantially encompasses an outlet with which it is aligned.

6. A system as in claim 5, in which the groove has a helical shape.

7. A system as in claim 6, wherein said helical groove has a depth greater than half the distance from the circumferential surface to the axis of said rotor.

8. A system as in claim 5, wherein said inlet is shaped to cause water to flow into said housing parallel to said longitudinal axis.

9. A fluid distribution valve, comprising:

a housing having an inlet and a plurality of outlets; and a rotor which is rotatably disposed in the housing and shaped so as to be rotated by said water flowing into the housing from the inlet, said rotor including a water conduit that sequentially aligns with and connects the outlets to the inlet as the rotor rotates, said conduit having an area that substantially encompasses an outlet with which it is aligned;

said housing having a longitudinal axis about which the rotor is rotatably disposed, said inlet being shaped such that said fluid flows through the inlet into the housing along said longitudinal axis, and said outlets being longitudinally spaced from each other parallel to said longitudinal axis.

10. A valve as in claim 9, wherein said outlets have circular cross-sections.

11. A valve as in claim 9, further comprising additional outlets that are spaced around said housing and arranged in longitudinal rows parallel to said longitudinal axis.

12. A fluid distribution valve, comprising:

a housing having an inlet and a plurality of outlets; and a rotor which is rotatably disposed in the housing and shaped so as to be rotated by fluid flowing into the housing from the inlet and sequentially connect the outlets to the inlet as the rotor rotates;

said housing having a longitudinal axis about which the rotor is rotatably disposed and said outlets being longitudinally spaced from each other parallel to said longitudinal axis; and said rotor being formed with a circumferential surface and a groove in said circumferential surface against which said fluid impinges from the inlet to cause rotation of the rotor, said groove sequentially aligning with the outlets upon rotation of the rotor, said groove having an area that substantially encompasses an outlet with which it is aligned.

13. A valve as in claim 12, in which the groove has a helical shape.

14. A valve as in claim 13, wherein said helical groove has a depth greater than half the distance from the circumferential surface to the axis of said rotor.

15. A valve as in claim 12, wherein said inlet is shaped to cause water to flow into said housing parallel to said longitudinal axis.

* * * * *